United States Patent [19]

Garner, Jr.

[11] 4,263,968

[45] Apr. 28, 1981

[54] HYDRAULIC SET AND STRAIGHT PULL RELEASE WELL PACKER

[75] Inventor: James K. Garner, Jr., Houston, Tex.

[73] Assignee: Camco, Incorporated, Houston, Tex.

[21] Appl. No.: 129,454

[22] Filed: Mar. 11, 1980

[51] Int. Cl.[3] ..... E21B 23/06; E21B 33/128; E21B 33/129

[52] U.S. Cl. ..... 166/120; 166/212; 166/217

[58] Field of Search ..... 166/120, 212, 118, 134, 166/217, 187

[56] References Cited

U.S. PATENT DOCUMENTS

| | | | |
|---|---|---|---|
| 3,002,561 | 10/1961 | Baker et al. | 166/120 |
| 3,215,207 | 11/1965 | Sizer | 166/134 X |
| 3,456,723 | 7/1969 | Current et al. | 166/120 |
| 3,603,388 | 9/1971 | Current et al. | 166/120 |
| 3,659,647 | 5/1972 | Brown | 166/120 |
| 3,976,133 | 8/1976 | Allen | 166/120 |
| 3,991,826 | 11/1976 | Baugh | 166/212 X |

*Primary Examiner*—Stephen J. Novosad

*Attorney, Agent, or Firm*—Fulbright & Jaworski

[57] ABSTRACT

A well packer adapted to be set in a conduit disposed in a well bore having initially retracted packing seal means and initially retracted slip means which are set by opposing acting hydraulically actuated pistons. A single one-way clutch is connected between the pistons allowing simultaneous movement of the pistons for setting and holding the packer centrally in the conduit. A releasable sub includes an abutment member initially positioned against the top of the packing seal means with a housing telescopically surrounding and initially holding the abutment in position. An outer member is releasably connected to the housing and to a packer expander sleeve and various coacting shoulders are provided between the components whereby vertical movement upwardly of the packer housing will release the set packer.

5 Claims, 12 Drawing Figures

HYDRAULIC SET AND STRAIGHT PULL RELEASE WELL PACKER

BACKGROUND OF THE INVENTION

It is old to provide a hydraulically set and mechanically released well packer as disclosed in U.S. Pat. Nos. 3,456,723 and 3,603,388. The present invention is directed to an improved well packer which is simpler and less expensive than the prior art. The present packer is hydraulically set by dual opposing pistons actuated by hydraulic pressure, one of which sets the slips and the other which sets the packer seal in unison centralizing the packer and the well. The packer is released by the simple straight upward motion. A single one-way clutch is connected between the pistons for allowing simultaneously movement of one of the pistons upwardly and the other of the pistons downwardly for setting and holding the packer centrally in the conduit. Various improvements are provided in the packer to simplify its construction and operation.

SUMMARY

The present invention is directed to a hydraulic set and straight pull release well packer having an initially retracted packing seal means and an initially retracted slip means surrounding a mandrel in which dual, but opposed hydraulically actuated pistons, simultaneously set the packing seal and the slips for setting and holding the packer centrally in a conduit. One-way clutch means are connected between the piston means which allow simultaneous movement of the piston means and hold the packer in the set position.

Another feature of the present invention is a provision of a releasable sub which released a set packer upon a straight upper pull and which includes an abutment member initially positioned against the top of the packing seal means, a housing telescopically surrounding the upper end of the mandrel and initially holding the abutment in engagement with the mandrel, a vertically extending spline and groove between the housing and the mandrel, an outer member releasably connected to the housing, and a packer expander sleeve connected to the outer member. Coacting shoulders are provided between the various components whereby upward movement of the housing releases the packing seal and slip.

Still a further object is the provision of a recess in the mandrel and in which the abutment member includes a plurality of blocks initially positioned in the recess and held therein by the housing but released therefrom when the housing is moved upwardly. The abutment member and the recess include beveled upper and lower edges.

Still a further object of the present invention is the provision of shear means between the slip setting piston means and the packer setting means which, when sheared by hydraulic pressure, allows the movement of both piston means.

Yet a further object is the provision wherein the cross-sectional area of the slip setting piston is larger than the cross-sectional area of the packer setting piston for providing a larger setting force on the slips than on the packer seal.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
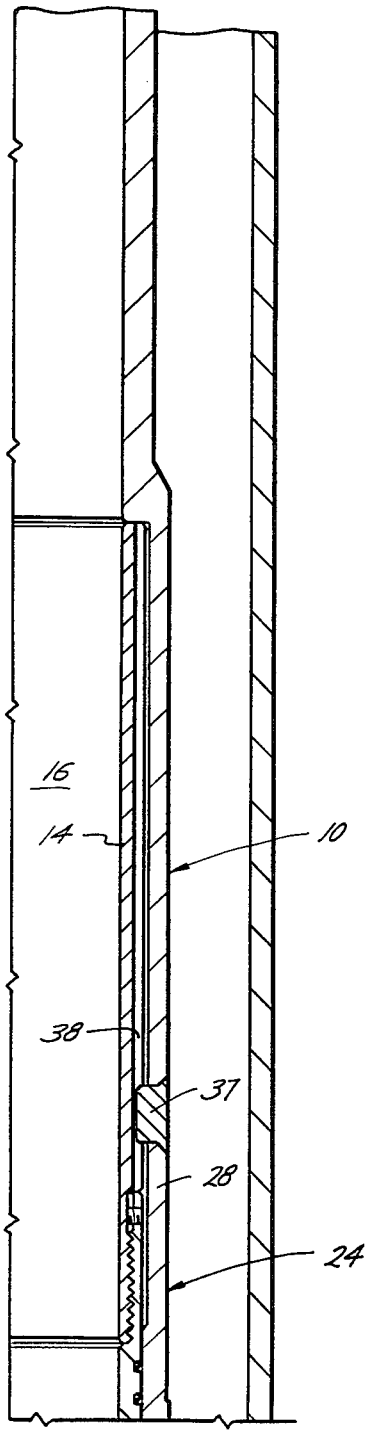
FIGS. 1A, 1B, 1C, and 1D are continuations of a fragmentary elevational view, in quarter section, of the present invention as the packer is being run into a well conduit.
Figure 1B:
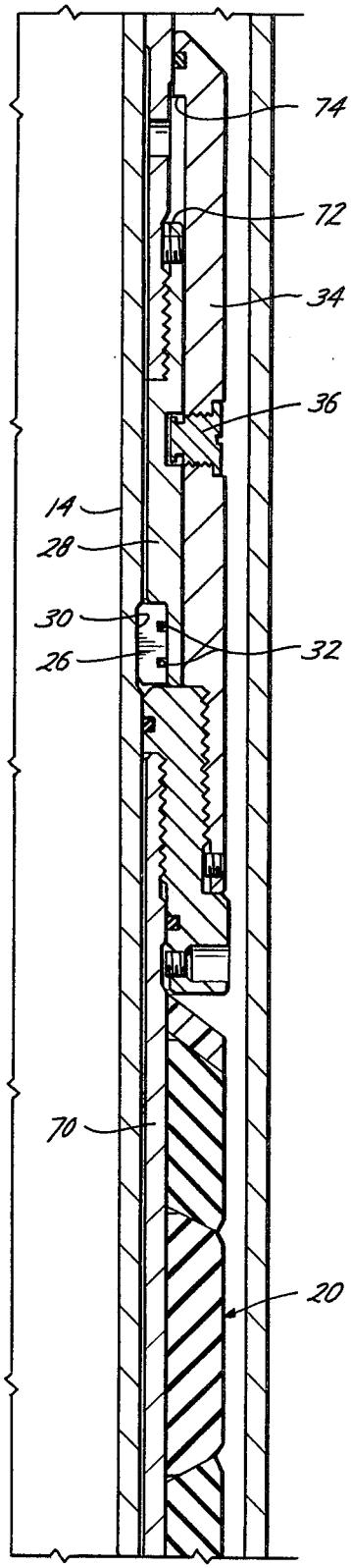

Referring now to the drawings, and particularly to FIGS. 1A–1D, the packer of the present invention is generally indicated by the reference numeral 10, and is shown being lowered into position in a conduit 12 such as a casing in a well bore by means of running in string (not shown) which is generally threadably connected to the packer 10. In order to set the packer 10 by hydraulic fluid, a suitable plugging tool (not shown) is connected to the lower end of the packer 10 to block the bottom so that hydraulic pressure may be applied therein.

The packer 10 includes a mandrel 14 which has an internal passageway 16 for receiving hydraulic fluid to set the packer and includes at least one port 18. The packer includes the usual packing sealing means generally indicated by the reference numeral 20, and an initially retracted slip means surrounding the mandrel 14 generally indicated by the reference numeral 22 (FIG. 1D).

A top releasing assembly is generally indicated by the numeral 24 and includes an upper abutment 26 for engaging the top of the packer sealing means 20, a housing 28 telescopically surrounding the upper end of the mandrel 14 and holding the abutment 26 initially in engagement with the mandrel 14 as will be more fully described hereinafter.

Figure 1C:
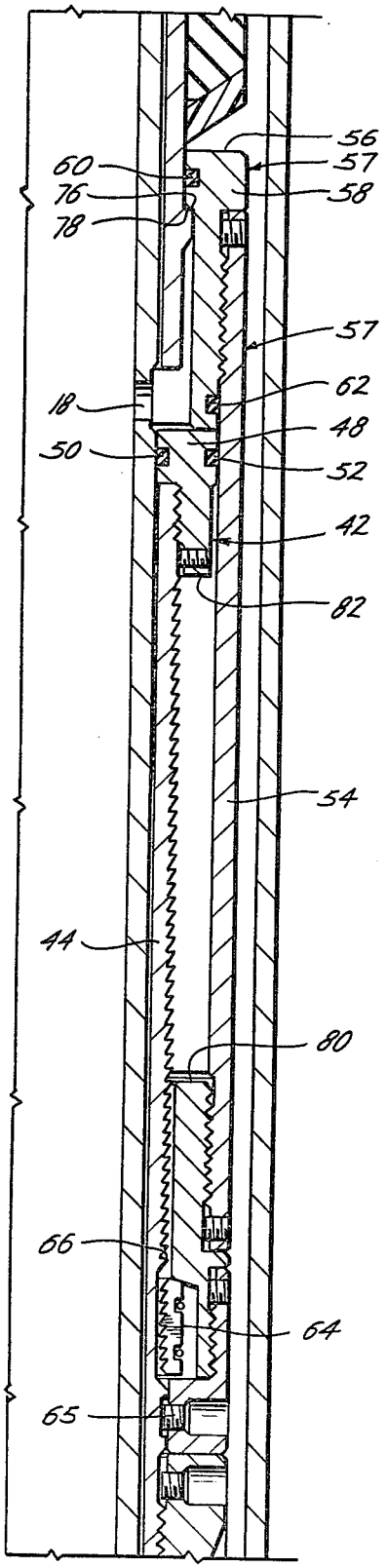
Figure 1D:
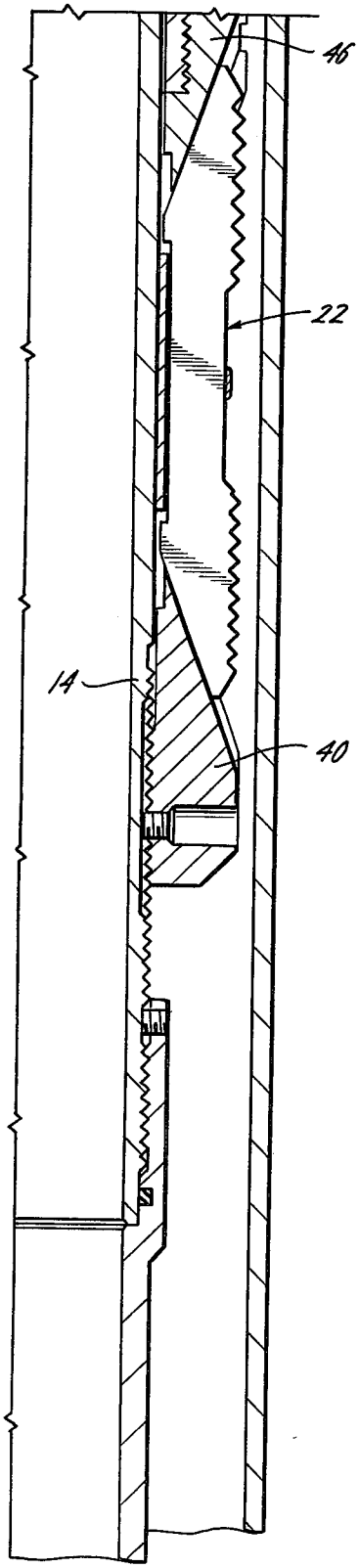
Figure 2A:
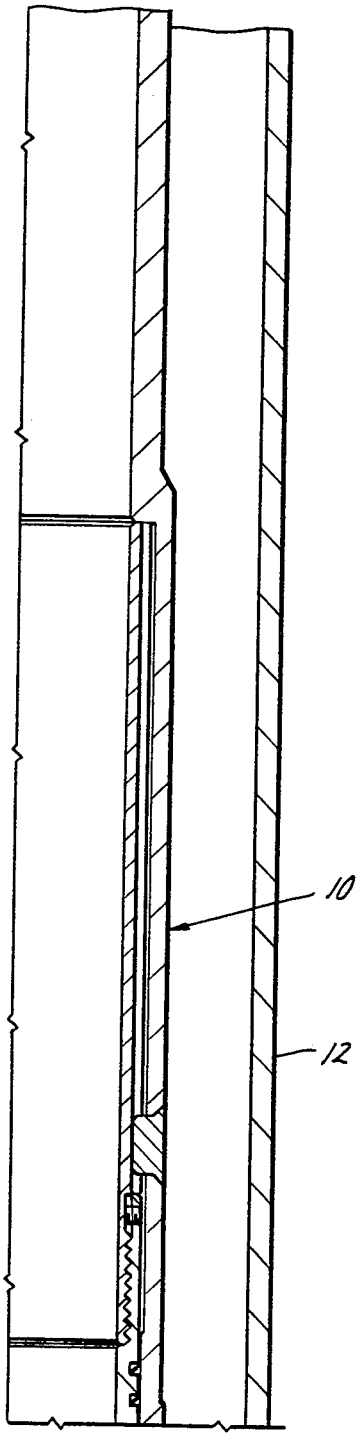
FIGS. 2A, 2B, 2C, and 2D are continuations of a fragementary elevational view, in quarter section, of the packer of the present invention set in a well conduit.
Figure 2B:
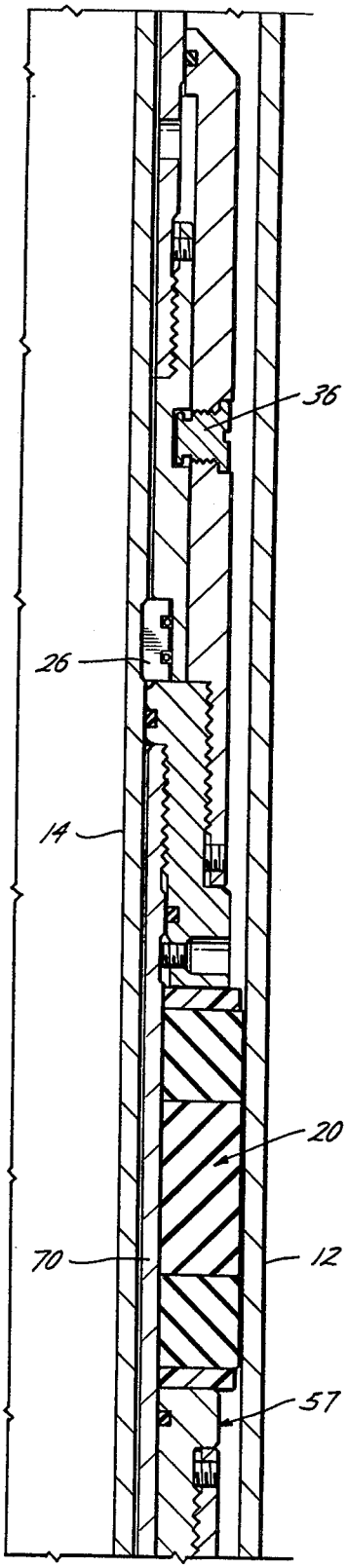
Figure 2C:
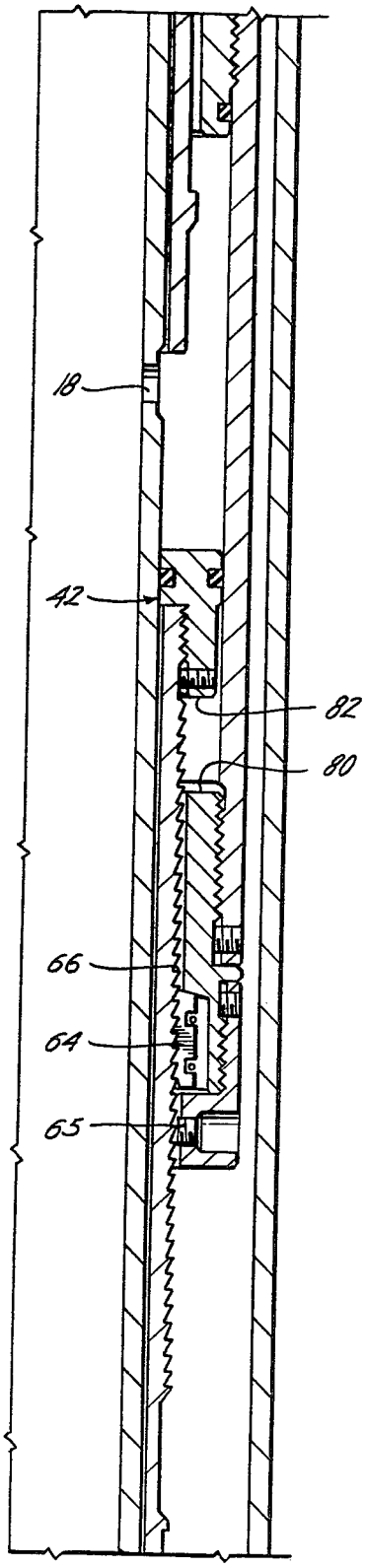
Figure 2D:
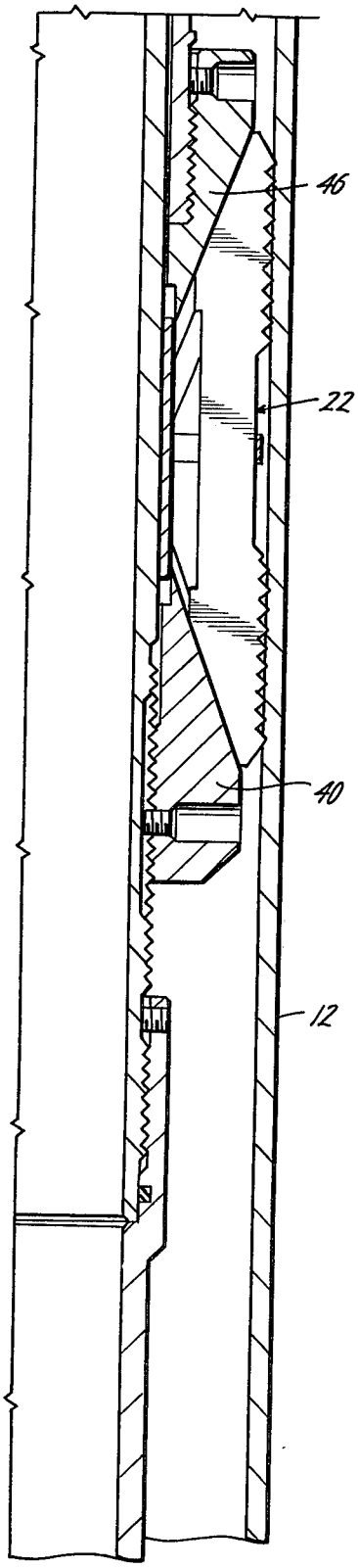
Figure 3A:
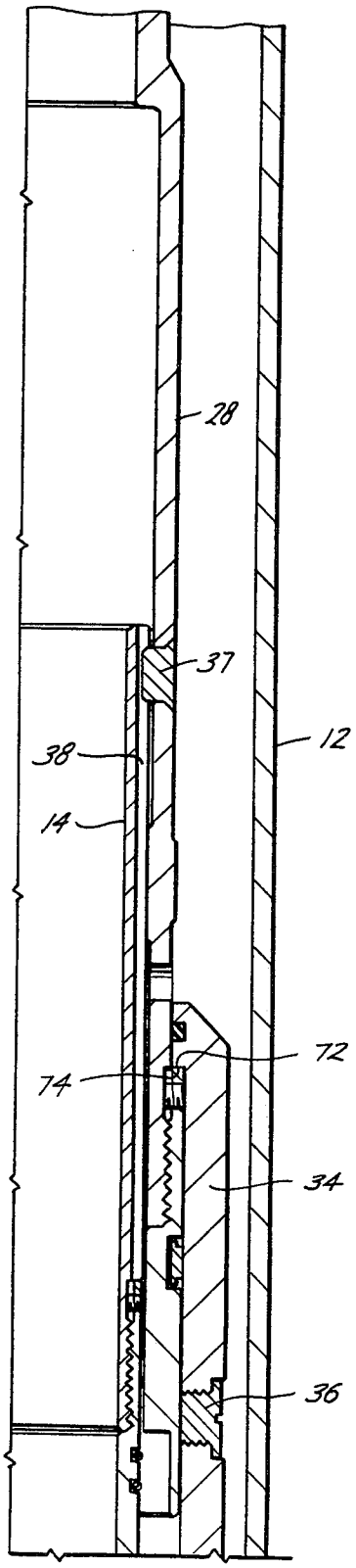
FIGS. 3A, 3B, 3C, and 3D are continuations of a fragmentary elevational view, in cross section, of the packer of the present invention in its released position.
Figure 3B:
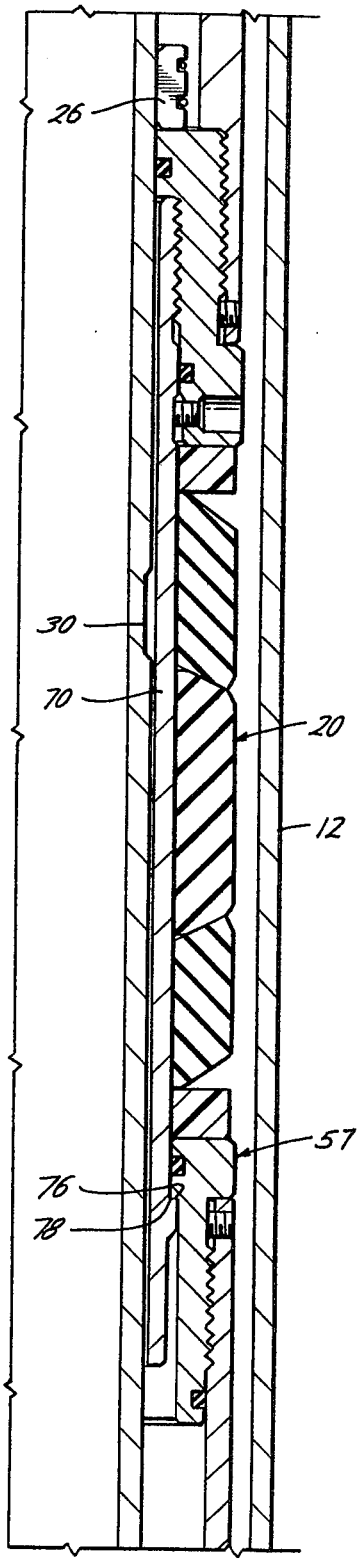
Figure 3C:
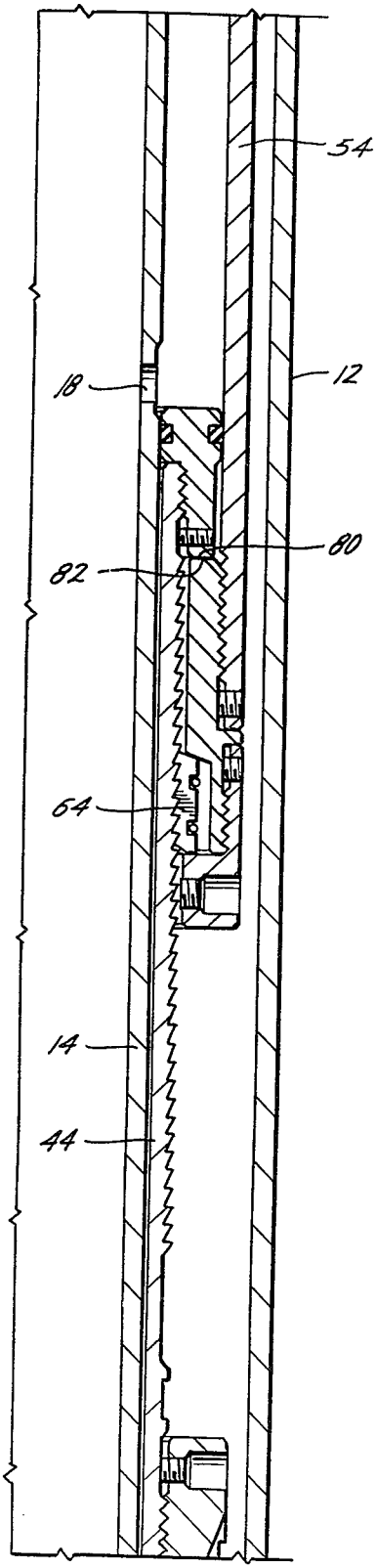
Figure 3D:
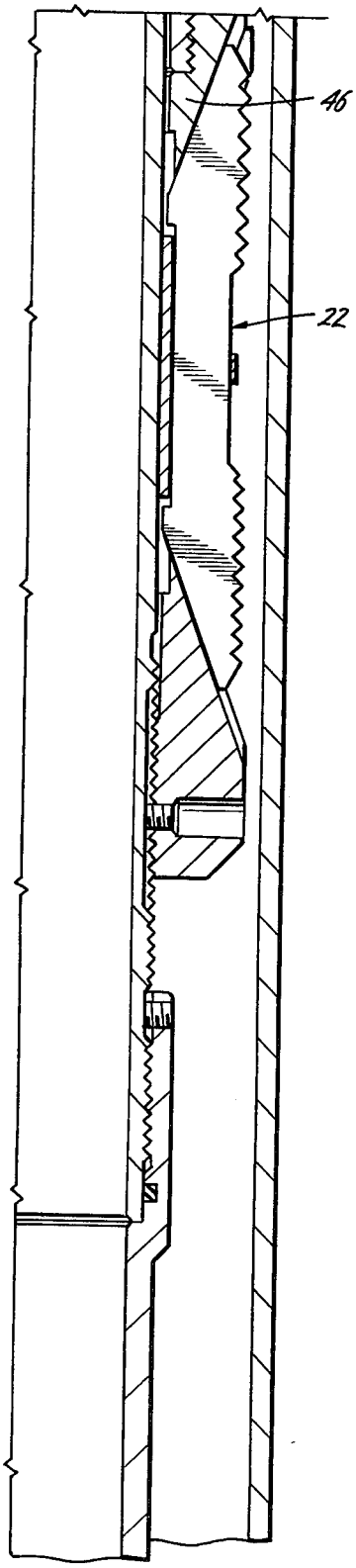

Referring now to FIGS. 1C and 1D, a lower slip cone 40 is secured to the mandrel 14 and against the lower end of the slip means 22. A hydraulically actuated slip setting piston means 42 which includes slip setting sleeve 44, and upper movable slip cone 46 and piston 48 defined by seals 50 and 52 which is in communication with port 18 for actuation of the piston 48 and slip means 22 outwardly and into engagement with the casing 12.

A hydraulically actuated packer seal setting piston means 57 which includes a packer seal setting sleeve 54 the upper end 56 of which is positioned adjacent the bottom of the seal means 20 and a piston 58 formed between seals 60 and 62. The piston 58 communicates with the port 18 for actuation by hydraulic pressure for movement upwardly against the packer seal means 20 for setting the seal.

A one-way clutch includes a plurality of threaded segments 64 which engage an external helical thread 66 between the sleeve 54 and the sleeve 44 which allows upward movement of the packer seal setting piston means 57 and simultaneously downward movement of the slip setting piston means 42 when hydraulic pressure is applied through the port 18 for setting and holding the packer 10 in the conduit 12. Initially, a shear pin 65 locks the sleeves 54 and 44 together preventing their inadvertent actuation as the packer 10 is moved down the conduit 12. However, when sufficient hydraulic pressure is pumped through port 18, the shear pin 65 is sheared releasing both the piston setting means 57 and 42 for simultaneous movement. Therefore, both the packer seal means 20 and the slip means 22 are simultaneously actuated for insuring that the packer is aligned in and centrally set in the conduit 12. It is also noted that the cross-sectional area of the slip setting piston 48 is larger than the cross-sectional area of the packer setting piston 58 to insure that the force applied to the slip assembly 22 is greater than the force applied to the seal assembly 20 for securely holding the packer 10 in vertical position in the conduit 12.

The setting of the packer 10 is best seen in FIGS. 2A–2D wherein fluid pressure is applied to the internal passageway 16, through the port 18 and against both of the packer seal setting pistons 48 and the slip setting piston 58. Upon a predetermined hydraulic pressure, shear pin 65 is sheared and the packer seal setting piston 48 will move upwardly against the seal means 20 compressing and displacing it against the abutment 26 and outwardly into engagement with the well conduit 12 to provide a seal. Simultaneously, the slip setting piston 48 will move downwardly actuating slip cone 46 towards the lower cone 40 to move the slip means 22 outwardly and into engagement with the inside wall of conduit 12. The one-way clutch 64 and 66 between the seal setting sleeve 54 and the slip setting sleeves 44 acts to hold the sleeves 44 and 54 in their expanded position and thus hold the packer means 20 and the slip means 22 in an expanded set position. The one-way clutch 64 and 66 and the slip means 22 may be of the type more fully described in U.S. Pat. No. 3,456,723.

Referring again to FIGS. 1A and 1B, the top releasing assembly 24 includes a housing 28 which initially holds abutment 26 against the upper end of the seal means 20. That is, the abutment 26 include a plurality of abutment segments which are initially positioned in an annular recess 30 in the mandrel 14 by garter springs 32 and are held in the recess 30 by the housing 28 to stop any upward movement of the seal means 20 as the seal is expanded outwardly into the setting postion. The assembly 24 also includes an outer member 34 which is releasably connected to the housing 28 by shear pin 36. A vertically extending spline 37 and groove 38 are provided between the housing 28 and the mandrel 14 which allow telescoping movement between the housing 28 and mandrel 14 after the shear pin 36 is sheared. The outer member 34 is connected to a releasing sleeve 70. A plurality of coacting shoulders is provided in the various components for engaging and retracting various members for releasing the seal means 20 and slip means 22. Thus coacting shoulders 72 and 74 are provided on the housing 28 and outer member 34 respectively. Coacting shoulders 76 and 78 are provided between the releasing sleeve 70 and the packer seal setting piston means 57. And coacting shoulders 80 and 82 are provided between the packer seal setting piston means 57 and the slip setting piston means 42.

Referring now to FIGS. 3A–3D, the release of the packer 10 from the conduit 12 by straight upward pull is best seen. With a upper pull taken on the outer housing 28, shear pin 36 is sheared and the vertical spline 37 and groove 38 connection between the housing 28 and mandrel 14 allows an upward movement of the housing 28 whereby the lower end of the housing 28 is removed from engagement with the abutment 26. Further upward movement of the housing 28 causes the coacting shoulders 72 and 74 on the housing 28 and outer member 34 to engage thereby moving the outer member 34 and releasing sleeve 70 upwardly. The setting force on the seal means 20 is released allowing the seal means 20 to resiliently retract away from its sealing relationship with the interior of the conduit 12. Upward movement of the releasing sleeve 70 causes engagement of coacting shoulders 76 and 78 between the releasing sleeve 70 and the packer seal setting piston means 57 allowing the packer seal setting piston means 57 to ratchet upwardly relative to the slip setting piston means 42 until coacting shoulders 80 and 82 therebetween come into engagement for pulling the upper movable slip cone 46 away from the lower slip cone 40 to allow the slip means 22 to be retracted away from the interior wall of the conduit 12.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which readily suggest themselves to those skilled in the art and which are encompassed within the spirit of the invention and the scope of the appended claims. 9n

What is claimed is:

1. A well packer adapted to be set in a conduit disposed in a well bore comprising, a mandrel having a fluid port, initially retracted packing seal means surrounding said mandrel, initially retracted slip means surrounding said mandrel and positioned below said packing seal means, packer seal setting piston means surrounding the mandrel and exposed to the port for moving toward the packing seal means for expanding the packer seal in response to fluid pressure through the port and including a packer sleeve extending downardly, slip setting piston means surrounding the mandrel and exposed to the port for moving toward the slip means for expanding the slip means in response to fluid pressure through the port and including a slip sleeve extending downwardly coaxially with the packer sleeve, one-way clutch means connected between the packer sleeve and the slip sleeve allowing simultaneous movement of the packer piston upward and the slip piston downward for setting and holding the packer centrally in the conduit, a releasable sub including, an abutment member initially positioned against the top of the packing seal means, a housing telescopically surrounding the upper end of the mandrel and initially holding the abutment in engagement with the mandrel, a vertically extending spline and groove between the housing and the mandrel, an outer member releasably connected to the housing, a packer expander sleeve connected to the outer member, coacting shoulders between the housing and the outer member, coacting shoulders between the expander sleeve and the packer setting piston, and coacting shoulders between the packer setting piston and the slip setting piston whereby upward movement of the housing releases the set packer.

2. The apparatus of claim 1 wherein the cross-sectional area of the slip setting piston is larger than the cross-sectional area of the packer setting piston.

3. The apparatus of claim 1 including shear means connected between the slip setting piston means and the packer setting piston means which when sheared by hydraulic pressure allows the movement of both piston means.

4. The apparatus of claim 1 wherein the mandrel includes a recess adjacent the abutment member, and the abutment member includes a plurality of abutment blocks initially positioned in said recess and held therein by the said housing but released therefrom when the housing is moved upwardly.

5. The apparatus of claim 4 wherein the abutment member and the recess include beveled upper and lower edges.

* * * * *